US006702384B1

(12) United States Patent
Brown

(10) Patent No.: US 6,702,384 B1
(45) Date of Patent: Mar. 9, 2004

(54) SUPPORT DEVICE

(76) Inventor: Christopher D. Brown, 27236 J C La., Bonita Springs, FL (US) 34135

( * ) Notice: Subject to any disclaimer, the term of this patent is extended or adjusted under 35 U.S.C. 154(b) by 35 days.

(21) Appl. No.: 09/976,808

(22) Filed: Oct. 12, 2001

(51) Int. Cl.[7] ..... A47C 1/02

(52) U.S. Cl. ..... 297/344.18; 297/195.11; 297/440.24; 182/204; 248/407

(58) Field of Search ..... 297/4, 195.1, 195.11, 297/202, 440.24, 461, 451.13, 41, 440.1, 344.18, 60; 182/204; 248/407, 408, 188.5

(56) References Cited

U.S. PATENT DOCUMENTS 2,675,256 A * 4/1954 Cornell
3,414,323 A 12/1968 Mitchum
4,183,579 A 1/1980 Gonzalez Y. Rojas
D271,352 S 11/1983 De Boer
4,865,382 A 9/1989 Marshall
5,364,163 A 11/1994 Hardison
5,465,673 A * 11/1995 Ma ..... 108/118
5,494,333 A * 2/1996 Wilson
D370,132 S * 5/1996 Urias
5,522,642 A * 6/1996 Herzog
5,536,063 A * 7/1996 Cable ..... 297/16.2
5,876,011 A * 3/1999 Blasing
5,927,797 A 7/1999 Ferguson
5,988,739 A * 11/1999 Dodge et al. ..... 297/195.1
6,045,180 A * 4/2000 Clutton
6,056,353 A * 5/2000 Meara
6,155,646 A * 12/2000 Sisson

* cited by examiner

*Primary Examiner*—Peter M. Cuomo
*Assistant Examiner*—Stephen Vu

(57) ABSTRACT

A support device is provided for leaning against by a generally upright person. The support device includes a seat portion having a top surface, a bottom surface and a peripheral edge extending between the top and bottom surfaces. A plurality of legs each has a first end and a second end. Each of the first ends is pivotally attached to the bottom surface of the seat portion. Each of the legs is located generally adjacent to the peripheral edge. The legs are spaced from each other. The legs are each telescoping and selectively extendable between extended and retracted positions.

19 Claims, 3 Drawing Sheets

SUPPORT DEVICE

BACKGROUND OF THE INVENTION

1. Field of the Invention

The present invention relates to stool devices and more particularly pertains to a new support device for providing a device for leaning against by a generally upright person.

2. Description of the Prior Art

The use of stool devices is known in the prior art. More specifically, stool devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,183,579; 5,364,163; 3,414,323; 5,927,797; 4,865,382; and Des. 271,352.

While these devices fulfill their respective, particular objectives and requirements, the aforementioned patents do not disclose a new support device. The inventive device includes a seat portion having a top surface, a bottom surface and a peripheral edge extending between the top and bottom surfaces. A plurality of legs each has a first end and a second end. Each of the first ends is pivotally attached to the bottom surface of the seat portion. Each of the legs is located generally adjacent to the peripheral edge. The legs are spaced from each other. The legs are each telescoping and selectively extendable between extended and retracted positions.

In these respects, the support device according to the present invention substantially departs from the conventional concepts and designs of the prior art, and in so doing provides an apparatus primarily developed for the purpose of providing a device for leaning against by a generally upright person.

SUMMARY OF THE INVENTION

In view of the foregoing disadvantages inherent in the known types of stool devices now present in the prior art, the present invention provides a new support device construction wherein the same can be utilized for providing a device for leaning against by a generally upright person.

The general purpose of the present invention, which will be described subsequently in greater detail, is to provide a new support device apparatus and method which has many of the advantages of the stool devices mentioned heretofore and many novel features that result in a new support device which is not anticipated, rendered obvious, suggested, or even implied by any of the prior art stool devices, either alone or in any combination thereof.

To attain this, the present invention generally comprises a seat portion having a top surface, a bottom surface and a peripheral edge extending between the top and bottom surfaces. A plurality of legs each has a first end and a second end. Each of the first ends is pivotally attached to the bottom surface of the seat portion. Each of the legs is located generally adjacent to the peripheral edge. The legs are spaced from each other. The legs are each telescoping and selectively extendable between extended and retracted positions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new support device apparatus and method which has many of the advantages of the stool devices mentioned heretofore and many novel features that result in a new support device which is not anticipated, rendered obvious, suggested, or even implied by any of the prior art stool devices, either alone or in any combination thereof.

It is another object of the present invention to provide a new support device which may be easily and efficiently manufactured and marketed.

It is a further object of the present invention to provide a new support device which is of a durable and reliable construction.

An even further object of the present invention is to provide a new support device which is susceptible of a low cost of manufacture with regard to both materials and labor, and which accordingly is then susceptible of low prices of sale to the consuming public, thereby making such support device economically available to the buying public.

Still yet another object of the present invention is to provide a new support device which provides in the apparatuses and methods of the prior art some of the advantages thereof, while simultaneously overcoming some of the disadvantages normally associated therewith.

Still another object of the present invention is to provide a new support device for providing a device for leaning against by a generally upright person.

Yet another object of the present invention is to provide a new support device which includes a seat portion having a top surface, a bottom surface and a peripheral edge extending between the top and bottom surfaces. A plurality of legs each has a first end and a second end. Each of the first ends is pivotally attached to the bottom surface of the seat portion. Each of the legs is located generally adjacent to the peripheral edge. The legs are spaced from each other. The legs are each telescoping and selectively extendable between extended and retracted positions.

Still yet another object of the present invention is to provide a new support device that provides a support for a person to lean against while standing for a long period of time. The device is adjustable for the height of the user and for the amount of support they desire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
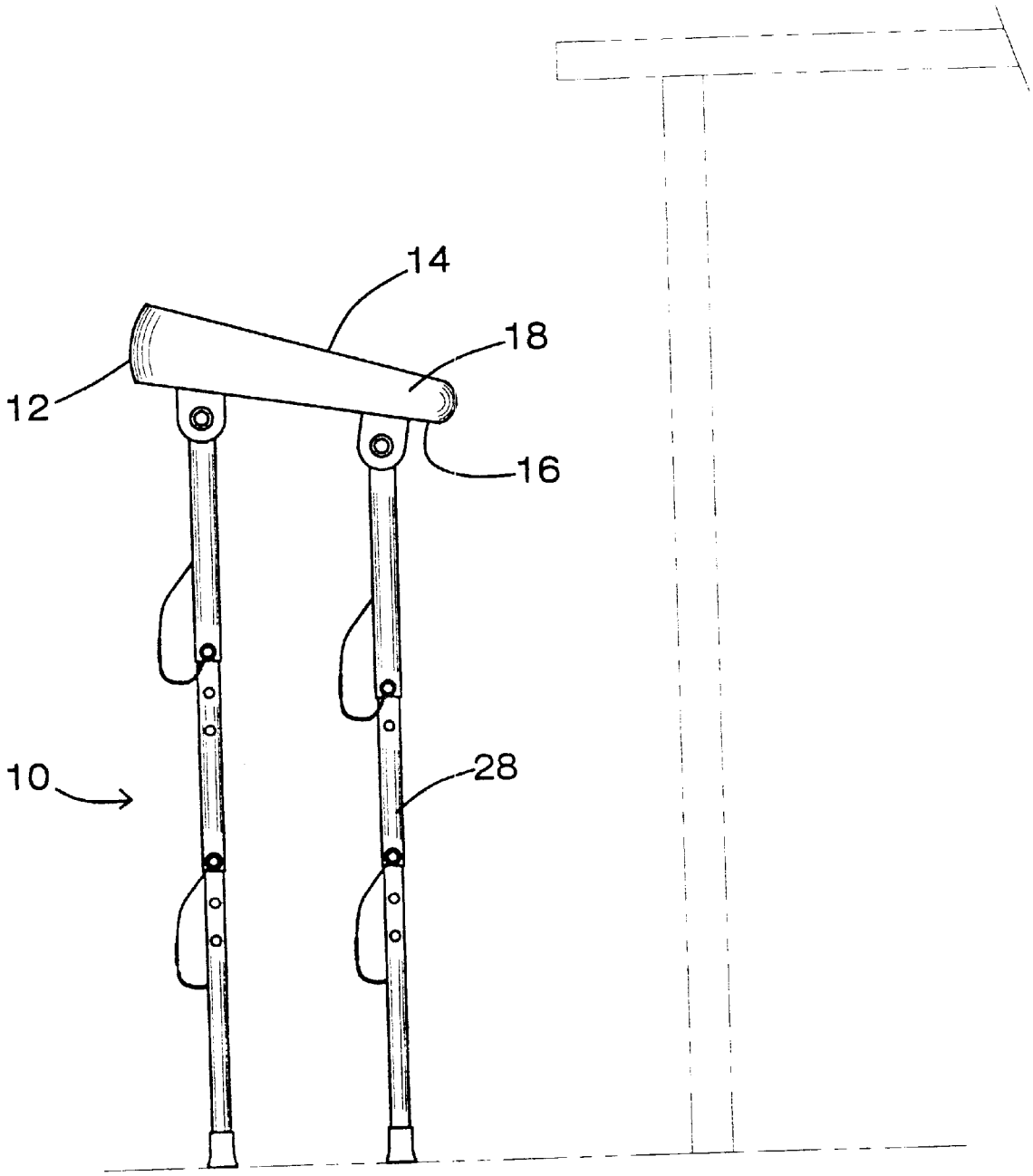
FIG. 1 is a schematic side view of a new support device according to the present invention.
Figure 2:
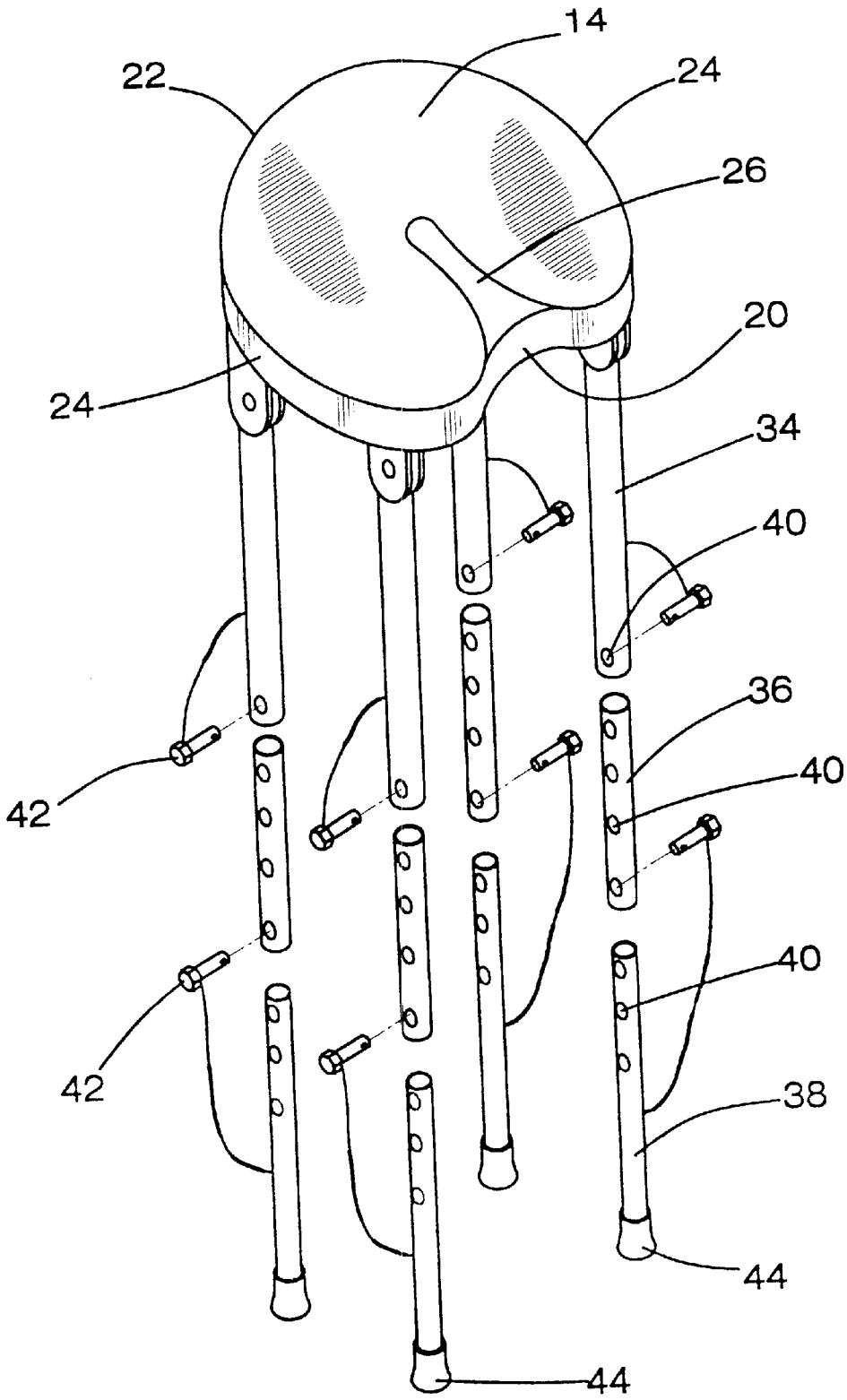
FIG. 2 is a schematic perspective view of the present invention.
Figure 3:
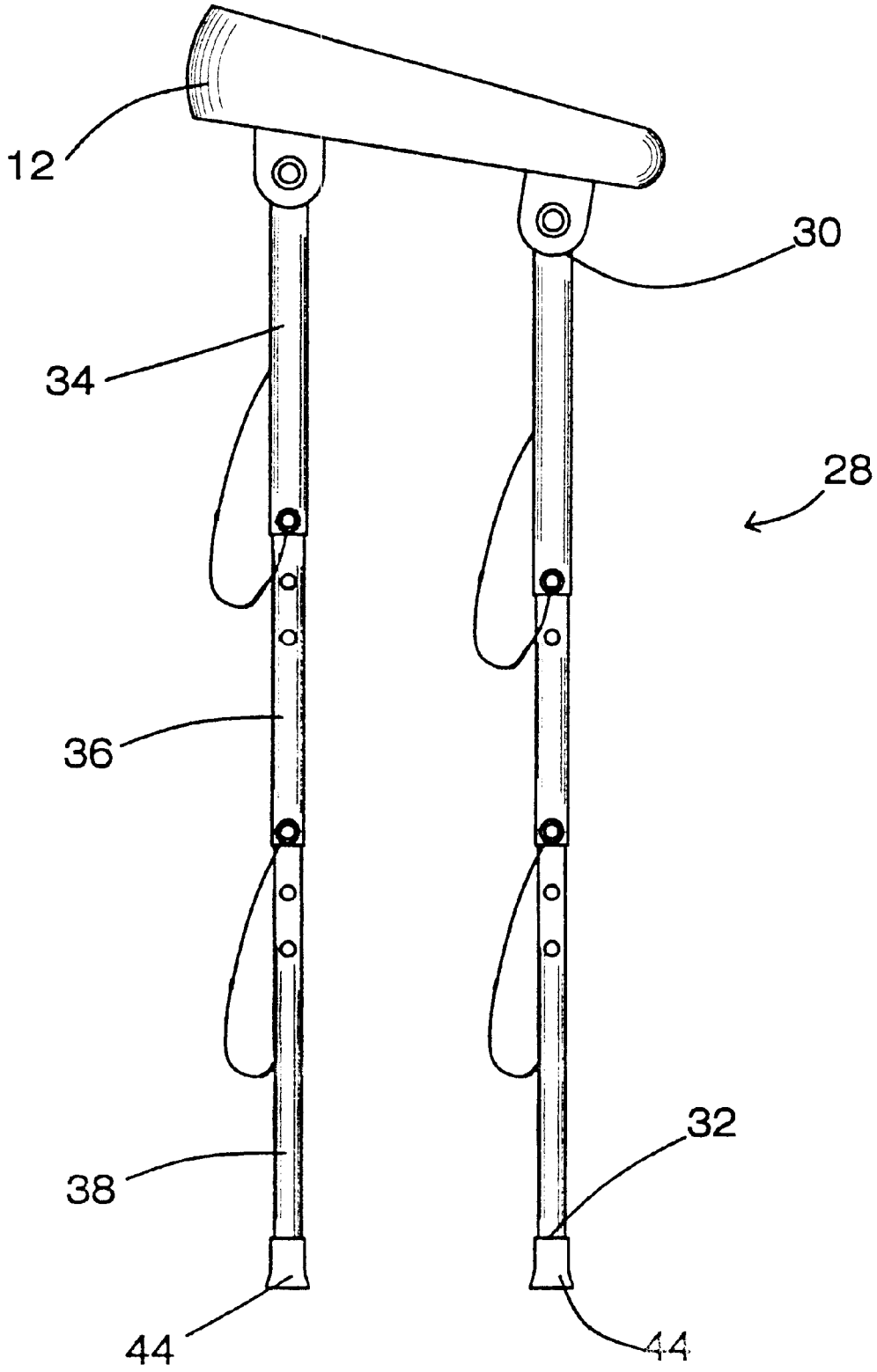
FIG. 3 is a schematic side view of the present invention.

With reference now to the drawings, and in particular to FIGS. 1 through 3 thereof, a new support device embodying the principles and concepts of the present invention and generally designated by the reference numeral 10 will be described.

As best illustrated in FIGS. 1 through 3, the support device 10 generally comprises a seat portion 12 having a top surface 14, a bottom surface 16 and a peripheral edge 18 extending between the top 14 and bottom 16 surfaces. The seat portion 12 includes a front edge 20, a back edge 22 and a pair of side edges 24. The front edge 20 extends inward toward the back edge 22, and the back edge 22 extends away from the front edge 20. The top surface 14 is concave. The top surface 14 has a raised section 26 positioned between the side edges 24 and extends from the front edge 20 toward the back edge 22. The peripheral edge 18 is rounded outwardly. The concave shape and the raised portion allow contouring to a person sitting on the top surface. Also envisioned is a cushion for placement on the top surface 14 and secured to the top surface 14 with a hook and loop fastening means.

A plurality of legs 28 each has a first end 30 and a second end 32. Each of the first ends 30 is pivotally attached to the bottom surface 16 of the seat portion 12. Each of the legs 28 is located generally adjacent to the peripheral edge 18. The legs 28 are spaced from each other. Each of the legs 28 is telescoping and is selectively extendable between extended and retracted positions. Preferably, each of the legs 28 has a first section 34, a second section 36 and a third section 38. The second section 36 is extendable into the first section 34 and the third section 38 is extendable into the second section 36. Each of the first sections 34 has an aperture 40 therein positioned generally adjacent to the second sections 36. The second 36 and third 38 sections each have a plurality of apertures 40 therein. Each of a plurality 40 of pins 42 is extendable through the apertures 40 for releasably securing each of the sections to an adjacent one of the sections. Preferably each of the pins 40 is tethered to the associated legs 28. The plurality of legs 28 is ideally four legs.

Each of a plurality of feet 44 is positioned over the one of the second ends 32 of the legs 28. The feet 44 each comprise an elastomeric material for preventing slippage of the legs 28.

In use, the device 10 is used for supporting a person who is in a generally upright position, such as a surgeon or factory worker who must remain on their feet for long periods of time. The pivoting and telescoping legs 28 allow the seat portion 12 to be tilted so that a user is leaning against the device 10 instead of placing their entire weight on the device. The telescoping legs 28 also allow the device to be adjusted to the height of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable support device comprising:

a seat portion having a top surface, a bottom surface and a peripheral edge extending between said top and bottom surfaces; and a plurality of legs each having a first end and a second end, each of said first ends being pivotally attached to said bottom surface of said seat portion, each of said legs being located generally adjacent to said peripheral edge, said legs being spaced from each other, each of said legs being telescoping and being selectively extendable between extended and retracted positions, each of said legs being independently pivotal;

wherein each of said legs has a first section, a second section and a third section, wherein said second section is extendable into said first section and said third section is extendable into said second section, each of said first sections having an aperture therein positioned generally adjacent to said second sections, each of said second and third sections having a plurality of apertures therein, each of a plurality of pins being extendable through said apertures for releasably securing each of said sections to an adjacent one of said sections.

2. The adjustable support device as in claim 1, wherein said seat portion includes a front edge, a back edge and a pair of side edges, said front edge extending inward toward said back edge.

3. The adjustable support device as in claim 2, wherein said back edge extends away from said front edge.

4. The adjustable support device as in claim 3, wherein said top surface is concave.

5. The adjustable support device as in claim 4, wherein said top surface has a raised section positioned between said side edges and extending from said front edge toward said back edge.

6. The adjustable support device as in claim 5, wherein said peripheral edge is rounded outwardly.

7. The adjustable support device as in claim 2, wherein said top surface is concave.

8. The adjustable support device as in claim 7, wherein said top surface has a raised section positioned between said side edges and extending from said front edge toward said back edge.

9. The adjustable support device as in claim 2, wherein said top surface has a raised section positioned between said side edges and extending from said front edge toward said back edge.

10. The adjustable support device as in claim 1, wherein said plurality of legs is four legs.

11. The adjustable support device as in claim 1, further including each of a plurality of feet being positioned over said one of said second ends of said legs, each of said feet comprising an elastomeric material.

12. The adjustable support device as in claim 1, further including each of a plurality of feet being positioned over said one of said second ends of said legs, each of said feet comprising an elastomeric material.

13. An adjustable support device comprising:

a seat portion having a top surface, a bottom surface and a peripheral edge extending between said top and bottom surfaces, said seat portion including a front edge, a back edge and a pair of side edges, said front edge extending inward toward said back edge, said back edge extending away from said front edge, said top surface being concave, said top surface having a raised section positioned between said side edges and extending from said front edge toward said back edge, said peripheral edge being rounded outwardly;

a plurality of legs each having a first end and a second end, each of said first ends being pivotally attached to said bottom surface of said seat portion, each of said legs being located generally adjacent to said peripheral edge, said legs being spaced from each other, each of said legs being telescoping and being selectively extendable between extended and retracted positions, each of said legs being independently pivotal, each of said legs having a first section, a second section and a third section, wherein said second section is extendable into said first section and said third section is extendable into said second section, each of said first sections having an aperture therein positioned generally adjacent to said second sections, each of said second and third sections having a plurality of apertures therein, each of a plurality of pins being extendable through said apertures for releasably securing each of said sections to an adjacent one of said sections, said plurality of legs being four legs; and each of a plurality of feet being positioned over said one of said second ends of said legs, each of said feet comprising an elastomeric material.

14. An adjustable support device comprising:

a seat portion having a top surface, a bottom surface and a peripheral edge extending between said top and bottom surfaces; and a plurality of legs each having a first end and a second end, each of said first ends being pivotally attached to said bottom surface of said seat portion, each of said legs being located generally adjacent to said peripheral edge, said legs being spaced from each other, each of said legs being telescoping and being selectively extendable between extended and retracted positions, each of said legs being independently pivotal;

wherein said plurality of legs is four legs;

wherein each of said legs has a first section, a second section and a third section, wherein said second section is extendable into said first section and said third section is extendable into said second section, each of said first sections having an aperture therein positioned generally adjacent to said second sections, each of said second and third sections having a plurality of apertures therein, each of a plurality of pins being extendable through said apertures for releasably securing each of said sections to an adjacent one of said sections;

wherein each one of a front pair of said plurality of legs has a first height and each one of a rear pair of said plurality of legs has a second height, said second height being greater than said first height, said height of said front pair of legs being adjustable to vary an angle of said top surface of said seat portion.

15. The adjustable support device as in claim 14, wherein said angle of said seat portion being adjustable between 20 and 50 degrees inclusive relative to horizontal.

16. The adjustable support device as in claim 14, wherein said angle of said seat portion being adjustable between 0 and 50 degrees inclusive relative to horizontal.

17. The adjustable support device as in claim 14, wherein said top surface is concave.

18. The adjustable support device as in claim 14, wherein said top surface has a raised section positioned between said side edges and extending from said front edge toward said back edge.

19. The adjustable support device as in claim 18, wherein said peripheral edge is rounded outwardly.

* * * * *